United States Patent [19]

Thompson

[11] 4,332,581

[45] Jun. 1, 1982

[54] ADJUSTABLE PAPER FOLDING APPARATUS

[75] Inventor: Doyle D. Thompson, Phoenix, Ariz.

[73] Assignee: Form Flo Equipment Manufacturers Inc., Phoenix, Ariz.

[21] Appl. No.: 121,693

[22] Filed: Feb. 15, 1980

[51] Int. Cl.[3] ..... B65H 45/20

[52] U.S. Cl. ..... 493/413; 493/410; 493/433

[58] Field of Search ..... 270/39, 79, 61 F, 73; 53/429, 116; 493/411-413, 414, 415, 430, 433, 448, 451

[56] References Cited

U.S. PATENT DOCUMENTS 3,124,350 3/1964 Huffman ..... 270/79

3,711,085 1/1973 Bunch ..... 270/79

*Primary Examiner*—Edgar S. Burr

*Assistant Examiner*—A. J. Heinz

*Attorney, Agent, or Firm*—Alter and Weiss

[57] ABSTRACT

A paper folding apparatus having an infinitely adjustable head designed for rotation from 0 degrees to 90 degrees in order to accommodate various required weights and lengths of paper. The apparatus is a part of a continuous in-line web-fed folding system which allows for variation in the folding head position to accommodate various paper weights, lengths and folding operation speeds, while reducing jams, tears and other problems associated with paper folding operations.

6 Claims, 3 Drawing Figures

ADJUSTABLE PAPER FOLDING APPARATUS

BACKGROUND OF THE INVENTION

The present invention relates, in general, to folding and processing equipment and more particularly to a variable angle folding head feature for paper folding equipment allowing, among other things, for the use of different weights of paper.

For many years, there have been numerous problems associated with paper folding machines. In general, folding machines have relied upon stationary folding heads which are capable of accommodating a small range of certain weights of paper to be folded. The heads are restrainably positioned on a horizontal plane or pre-set angle. Thus, each type of folding machine, in the prior art, being fixedly set at a particular certain folding head angle, could only accommodate certain weights and lengths of paper and only operate at certain speeds, dependent on those weights and lengths.

Folding machines with the stationary folding heads of the prior art have only been able to accommodate certain weights of paper due to the angle at which the paper leaves the head for release onto a delivery table or plane. It is the nature of this angle to change as a function of paper weight and length and apparatus folding speed.

It is thus an object of the present invention to provide a variable angle folding head apparatus which can accommodate a wide range of different weights and lengths of paper on a continuous, in-line folding machine.

It is further an object of this invention to provide a variable angle folding head apparatus which can vary infinitely in position from 0 degrees to 90 degrees in order to accommodate different weights and fold lengths of paper while being able to release the paper onto the delivery table with uniformity and without jams and tears occurring during the folding process.

In addition, it is an object of this invention to provide means for adjustment, such as by electric motor or by manually operable mechanical handle, to set the variable folding head to the angle required for the weight and length of paper being folded by a user.

These and other objects of the invention will become apparent as described by the present disclosure.

SUMMARY OF THE INVENTION

The present invention comprises a paper folding apparatus with a variable angle folding head which is capable of infinite adjustment through an effective range of, for example, of 0 degrees to 90 degrees, relative to the horizontal position of the output delivery table. The variable angle folding head can accommodate different weights and fold lengths of paper as may be required by a user as well as facilitating uninterrupted folding at higher speeds.

The variable angle folding head is operatively controlled by a worm gear-pinion assembly arrangement which is positioned on one side of a feed roller. The gear assembly may be operated through its worm and pinion mechanism as driven by power means connected thereto, or may be set through its range manually.

The worm gear assembly which simultaneously serves as an effective gear reducer, is rotated in order to adjust the angular position of the variable angle folding head. The folding head itself rotates about the input feed roller to change the angle of the folding head itself.

The paper is directed into the variable angle folding head where it enters the apparatus feed mechanism comprising an input roller. The relative position of the input roller remains stationary no matter which angle the folding head is positioned at.

The paper is guided by rollers through a feed chute which opens into a crimping mechanism. The crimping mechanism consists of a series of beaters which receives the paper in pre-designated intervals, crimps the paper and directs it, in desired folded lengths, to release spirals. The spirals maintain the folded edges as they move the paper through their downwardly rotating motion. As the paper reaches the furthermost downward position of the spirals, the folded paper portion is ejected onto the delivery table.

The angle at which the spirals and beaters are positioned relative to the delivery table, is based upon the angle that the overall folding head has been positioned in. This is to accommodate the various weights and lengths of folded paper which, by their nature, create different optimal release angles.

The preferred embodiment of the adjustable head is operated through the use of a power motor operably attached to the worm gear positioned adjacent the pinion gear assembly which operably sets the angular position of the variable angle folding head as desired by the user based on the weight, interval length and desired speed of the apparatus. Alternatively, a rotatable wheel or handle can be utilized to manually rotate the worm gear for subsequent adjustment of the operating head. It should be realized, however, that while pivoting of the folding head unit is required it need not be accomplished through a worm gear-pinion gear arrangement. It may, for example, be accomplished through tilting levers and the like.

DETAILED DESCRIPTION

Figure 1:
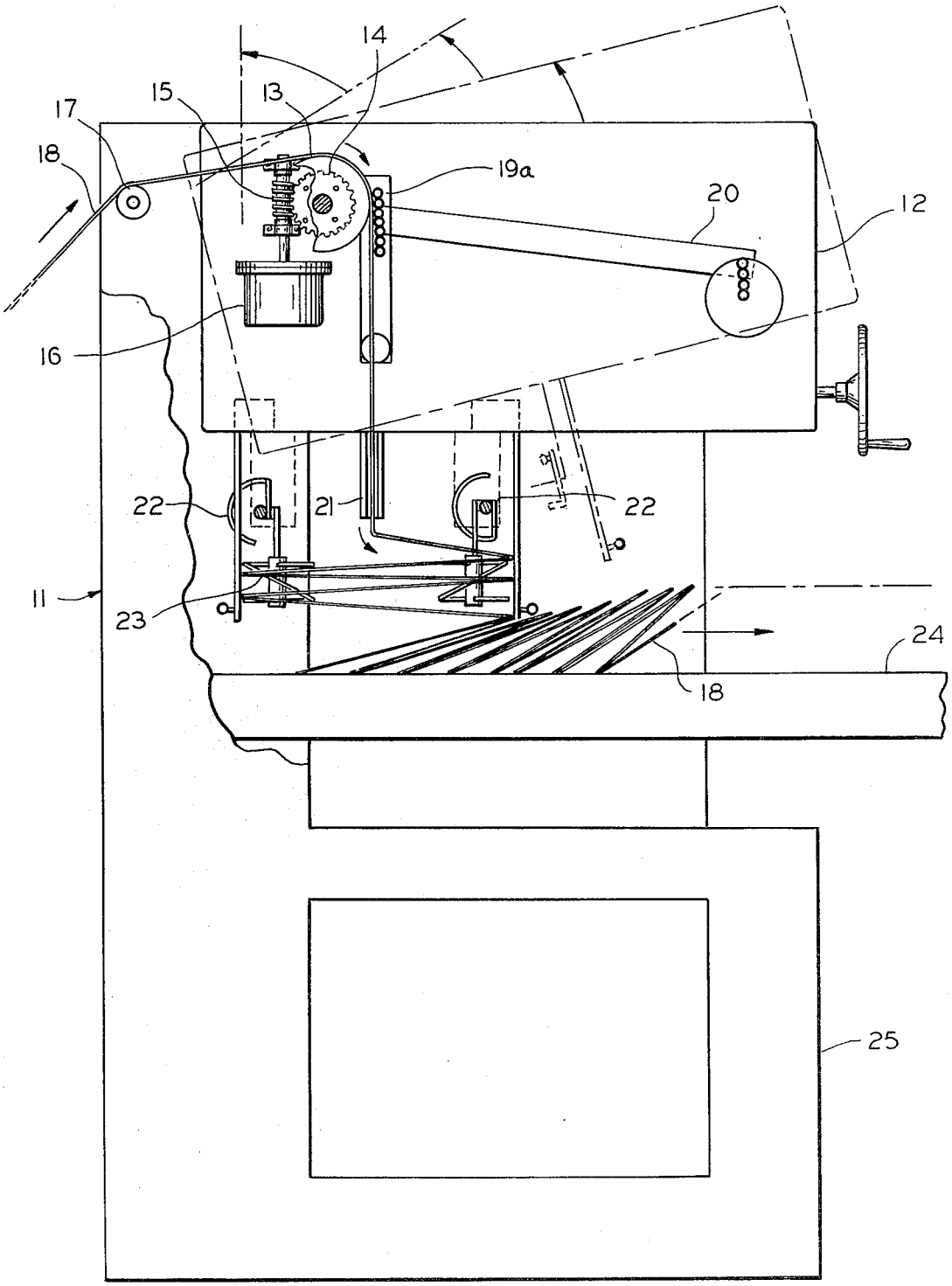
FIG. 1 of the drawings is a side elevational view of the variable angle folding apparatus showing its variable angle folding head portion enabling positioning of the head in different angular configurations.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The variable angle paper folding apparatus 11, as shown in FIG. 1, comprises the variable angle folding head 12 which may be adjusted to any position within substantial range, such as from 0 to 90 degrees, in order to accommodate different weights and folding lengths of paper 18. The paper 18 is continuously fed into the paper folding apparatus 11, and first enters through the variable angle folding head 12. Paper web 18 passes over guide roller 17 and feed roller 13. Pinion gear 14, in cooperation with worm gear 15 permits variation in the angle head portion 12 assumes. In the preferred embodiment gear assembly 14 with worm gear 15 and pinion gear 14 is connected to motorized power means 16 which enables a user to adjust the variable folding head to any exact folding angle necessary to accommodate the various weights and lengths of paper as may be required by a user.

The paper is further guided by roller 19 (of FIG. 3) in adjustment bracket 19*a*, and into chute means 21. The paper then enters the crimping mechanism which produces the folds and in turn delivers the paper to collection surface 24. It should be noted, as shown in FIG. 1, that the crimping mechanism is part of the variable folding head 12 itself and thus also rotates to the desired angle to accommodate the weight and fold length of the paper being used. The crimping mechanism ejects paper 18 after the paper is folded into desired lengths. Due to the variable weights of paper used in folding apparata, the invention accommodate a variable position and height to accommodate paper bulk arising from the folds for the paper, to permit unhampered ejection onto delivery table 24.

The crimping mechanism contains a series of beaters 22 which in turn direct the paper into spirals 23. The spirals 23 transfer the crimped, fan-folded paper by rotatably directing the crimped corner edges of the paper 18 and forcing the paper in a downward motion until it is released by the spirals. The folded paper 18 is released onto delivery table 24 in successive continuous portions.

Figure 2:
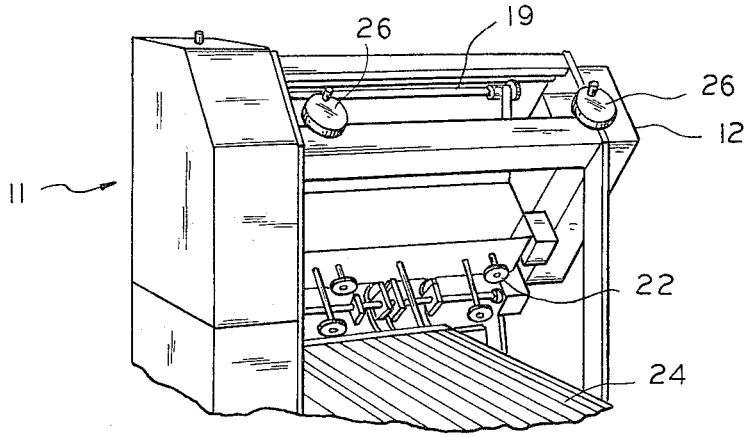
FIG. 2 of the drawings is a front perspective view of the variable angle folding head apparatus in a 45 degree angle to the delivery table which particularly shows the angled crimping mechanism of the head assembly.

As seen in FIG. 2, the variable angle folding head can be set at an approximate 45 degree angle for example. FIG. 2 shows the positioning of beaters 22 in relative position to the delivery table 24. The paper 18 passes through the series of beaters 22 which control and direct the paper through the crimping mechanism, and which in turn is directed into the spirals 23. The spirals 23 deliver the paper 18 in the desired fold length after which the folded paper is released and positioned on the the delivery table 24.

Figure 3:
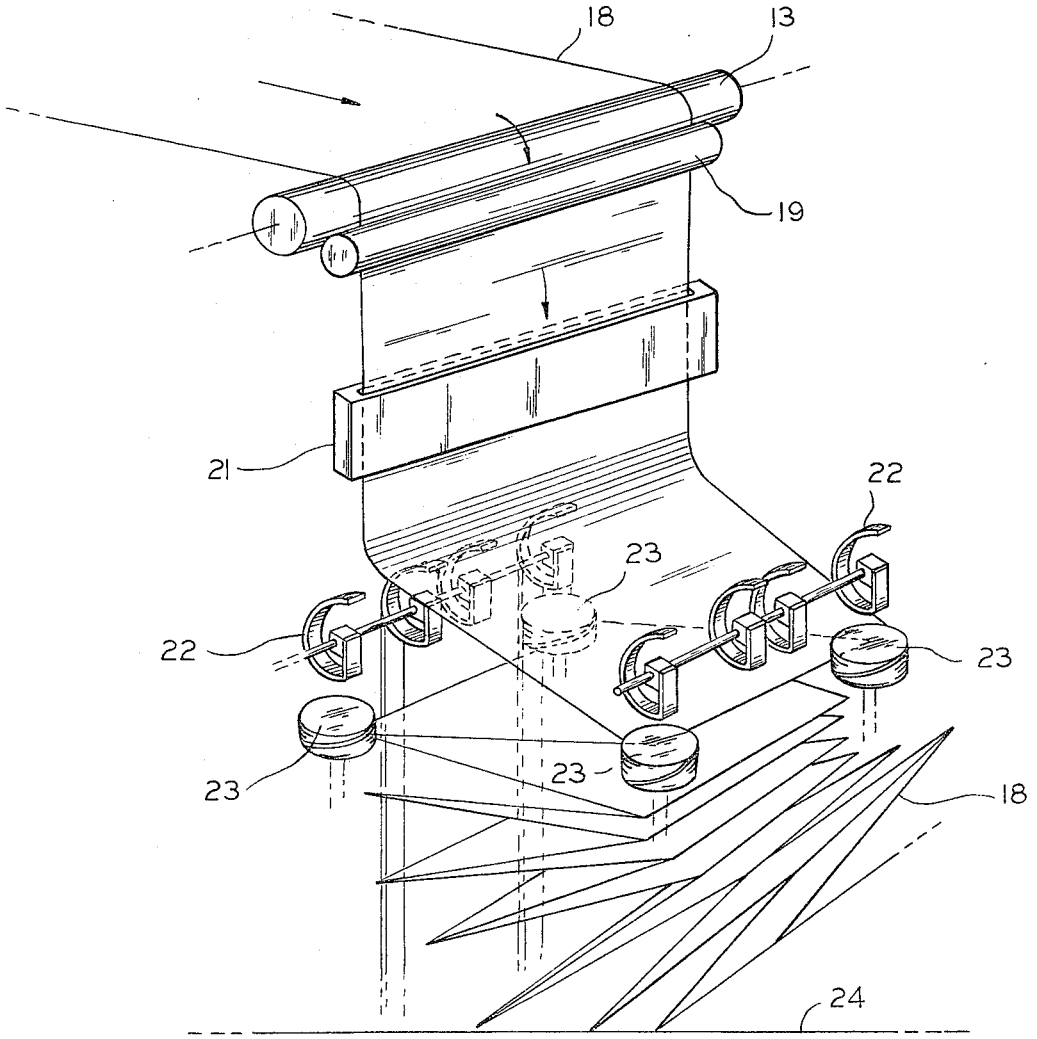
FIG. 3 of the drawings is a top perspective view of the invention showing the paper being fed into the head portion of the variable angle folding apparatus and in turn being directed into the crimping mechanism for folding of the paper in desired length intervals.

FIG. 3 shows an exploded view of paper 18 as it proceeds in the folding sequence through the variable paper folding apparatus 11.

While many folding applications can be accommodated through infinite variation of the head portion 12 in a range of 0 degrees to 60 degrees, the preferred embodiment permits variation through a range of 0 degrees to 90 degrees for maximum flexibility.

The foregoing description and drawings merely explain and illustrate the invention and the invention is not limited thereto, except insofar as the appended claims are so limited, as those skilled in the art have the disclosure before them will be able to make modifications and variations therein, without departing from the scope of the invention.

What is claimed is:

1. A variable position spiral-type paper folding apparatus for fan-folding a variety of webbed paper products of different paper weights and lengths and thus various folding bulks, said apparatus comprising:

folding mechanism means for crimping and delivering a web of paper in a fan-folded configuration;

said folding mechanism means including crimping means for repeatedly crimping folds into said webbed paper products and spiral release means for advancing and releasing said folded webbed paper product within and from said folding mechanism means;

said folding mechanism means having adjustment means for crimping and delivering paper webs of varied fold lengths and widths;

delivery surface means which cooperates with the spiral release means of said folding mechanism means, said delivery surface means being positioned in a substantially horizontal relationship to said folding mechanism means for receiving said fan-folded web of paper therefrom;

folding head means operably connected to and including said folding mechanism means and which further includes input roller means through which said web of paper enters said folding head prior to guiding into said folding mechanism means, and chute means for initially directing said paper web to said folding mechanism means;

said folding head means of said apparatus being pivotable about an axis independent of the positioning of said adjustment means of said folding mechanism means, so as to simultaneously vary the position of said folding mechanism means relative to said delivery surface means infinitely within an angularly adjustable range;

position maintenance means for maintaining the angular position of said pivotable folding head means after said variation of said position;

said adjustable range permitting the unhampered folding of said web of paper of said different weights and lengths by accommodating said varying folding bulk of same by altering the operable position of said folding head means and in turn said folding mechanism means relative to said delivery surface means so as to reduce jams, tears and other problems associated with the paper folding operation.

2. The invention according to claim 1 in which said angularly adjustable range through which said folding head means may be infinitely varied comprises the range generally of 0 to 90 degrees, between said folding head means and said delivery surface means.

3. The invention according to claim 1 in which said adjustability of said folding head means is accomplished through the utilization of worm gear means and pinion gear means which are operably connected with one another for angular movement of said folding head means;

said pinion gear means responding to rotation of said worm gear means to in turn pivot said adjustable folding head means so as to vary the position of said folding mechanism means relative to said delivery surface means;

said worm gear means and pinion gear means further comprising said position maintenance means by maintaining the angular position of said folding head means after said angular movement thereof.

4. The invention according to claim 3 in which said worm gear means comprises a worm gear which is operably connected for rotation to electric motor means for rotation thereof and in turn for the motorized pivoting of said folding head means.

5. The invention according to claim 1 in which said folding head means includes a plurality of beater bars and directing spirals through which said web of paper is crimped and delivered to said delivery surface means on a continuous basis.

6. A variable position spiral-type paper folding apparatus for fan-folding a variety of webbed paper products of different paper weights and lengths and thus various folding bulks, said apparatus comprising:

folding mechanism means for crimping and delivering a web of paper in a fan-folded configuration;

delivery surface means which cooperates with said folding mechanism means in a substantially horizontal position to said folding mechanism means for receiving said fan-folded web of paper therefrom;

folding head means operably connected to and including said folding mechanism means and which further includes input roller means through which said web of paper enters said folding head prior to guiding into said folding mechanism means, and chute means for initially directing said paper web to said folding mechanism means;

said folding head means of said apparatus being pivotable about an axis so as to simultaneously vary the position of said folding mechanism means relative to said delivery surface means infinitely through a radially adjustable range;

said folding head means being pivotable about said input roller means, both said folding head means and said input roller means relying upon a common axis about which said input roller means rotates and said folding head means pivots;

said adjustable range permitting the unhampered folding of said web of paper of said different weights and lengths by accommodating said varying folding bulk of same by altering the operable position of said folding head means and in turn said folding mechanism means relative to said delivery surface means so as to reduce jams, tears and other problems associated with the paper folding operation.

* * * * *